US008287310B2

(12) United States Patent
Burris et al.

(10) Patent No.: US 8,287,310 B2
(45) Date of Patent: Oct. 16, 2012

(54) COAXIAL CONNECTOR WITH DUAL-GRIP NUT

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 13/224,699

(22) Filed: Sep. 2, 2011

(65) Prior Publication Data

US 2011/0318958 A1 Dec. 29, 2011

Related U.S. Application Data

(63) Continuation of application No. 12/391,468, filed on Feb. 24, 2009, now Pat. No. 8,025,518.

(51) Int. Cl.
*H01R 9/05* (2006.01)

(52) U.S. Cl. ..... 439/578

(58) Field of Classification Search ..... 439/578, 439/322, 587, 595, 584, 607.19
See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 1,959,302 | A | 5/1934 | Paige |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,816,949 | A | 12/1957 | Curtiss |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |

(Continued)

FOREIGN PATENT DOCUMENTS

CA 2096710 A1 11/1994

(Continued)

OTHER PUBLICATIONS

Digicon AVL Connector. ARRIS Group Inc. [online] 3 pages. Retrieved from the Internet: <URL: http://www.arrisi.com/special/digiconAVL.asp.

*Primary Examiner* — Tulsidas C Patel
*Assistant Examiner* — Phuongchi Nguyen

(57) ABSTRACT

A connector for coaxial cable includes a dual-grip nut having a first external gripping surface and a second external gripping surface. The smallest outer diameter of the first external gripping surface is less than the smallest outer diameter of the second external gripping surface.

21 Claims, 8 Drawing Sheets

U.S. PATENT DOCUMENTS

| | | | |
|---|---|---|---|
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French ..... 174/89 |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,783,178 | A | 1/1974 | Philibert et al. |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,193,655 | A | 3/1980 | Herrmann, Jr. |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,273,405 | A | 6/1981 | Law |
| 4,280,749 | A | 7/1981 | Hemmer |
| 4,285,564 | A | 8/1981 | Spinner |
| 4,290,663 | A | 9/1981 | Fowler |
| 4,296,986 | A | 10/1981 | Herrmann, Jr. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smith |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,647,135 | A | 3/1987 | Reinhardt |
| 4,650,228 | A | 3/1987 | McMills et al. |

4,655,159 A 4/1987 McMills
4,655,534 A 4/1987 Stursa
4,660,921 A 4/1987 Hauver
4,668,043 A 5/1987 Saba et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,413,504 A 5/1995 Kloecker et al.
5,431,583 A 7/1995 Szegda
5,435,745 A 7/1995 Booth
5,435,751 A 7/1995 Papenheim et al.
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.

5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,951,327 A 9/1999 Marik
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,743 A 4/2000 Mitchell et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,257,923 B1 7/2001 Stone et al.
6,261,126 B1 7/2001 Stirling
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,676,446 B2 1/2004 Montena
6,683,253 B1 1/2004 Lee
6,692,285 B2 2/2004 Islam
6,692,286 B1 2/2004 De Cet
6,705,884 B1 3/2004 McCarthy
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,752,633 B2 6/2004 Aizawa et al.
6,767,248 B1 7/2004 Hung
6,780,068 B2 8/2004 Bartholoma et al.
6,786,767 B1 9/2004 Fuks et al.
6,790,081 B2 9/2004 Burris et al.
6,805,584 B1 10/2004 Chen ..... 439/578
6,817,896 B2 11/2004 Derenthal
6,848,939 B2 2/2005 Stirling
6,848,940 B2 2/2005 Montena
6,848,941 B2 2/2005 Wlos et al.
6,884,113 B1 4/2005 Montena
6,884,115 B2 4/2005 Malloy
6,929,265 B2 8/2005 Holland et al.
6,929,508 B1 8/2005 Holland
6,939,169 B2 9/2005 Islam et al.
6,948,976 B2 9/2005 Goodwin et al.
6,971,912 B2 12/2005 Montena et al.
7,029,326 B2 4/2006 Montena
7,070,447 B1 7/2006 Montena
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,179,121 B1 * 2/2007 Burris et al. ..... 439/578
7,229,303 B2 6/2007 Vermoesen et al.
7,252,546 B1 8/2007 Holland
7,255,598 B2 8/2007 Montena et al.
7,299,550 B2 11/2007 Montena
7,375,533 B2 5/2008 Gale
7,393,245 B2 7/2008 Palinkas et al.
7,452,239 B2 11/2008 Montena
7,455,550 B1 11/2008 Sykes
7,462,068 B2 12/2008 Amidon
7,476,127 B1 1/2009 Wei
7,479,035 B2 1/2009 Bence et al.
7,488,210 B1 2/2009 Burris et al.
7,494,355 B2 2/2009 Hughes et al.
7,497,729 B1 3/2009 Wei
7,507,117 B2 3/2009 Amidon
7,544,094 B1 6/2009 Paglia et al.
7,566,236 B2 7/2009 Malloy et al.
7,607,942 B1 10/2009 Van Swearingen
7,674,132 B1 3/2010 Chen
7,682,177 B2 3/2010 Berthet
7,727,011 B2 6/2010 Montena et al.
7,753,705 B2 7/2010 Montena
7,794,275 B2 9/2010 Rodrigues
7,806,725 B1 10/2010 Chen
7,811,133 B2 10/2010 Gray
7,824,216 B2 11/2010 Purdy
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,850,487 B1 12/2010 Wei
7,857,661 B1 12/2010 Islam
7,874,870 B1 1/2011 Chen
7,887,354 B2 2/2011 Holliday
7,892,005 B2 2/2011 Haube
7,892,024 B1 2/2011 Chen

| | | | | |
|---|---|---|---|---|
| 7,927,135 | B1 | 4/2011 | Wlos | |
| 7,950,958 | B2 | 5/2011 | Mathews | |
| 7,955,126 | B2 | 6/2011 | Bence et al. | |
| 8,025,518 | B2 * | 9/2011 | Burris et al. | 439/322 |
| 8,029,315 | B2 | 10/2011 | Purdy et al. | |
| 8,062,044 | B2 | 11/2011 | Montena et al. | |
| 8,075,338 | B1 | 12/2011 | Montena | |
| 8,079,860 | B1 | 12/2011 | Zraik | |
| 2002/0013088 | A1 | 1/2002 | Rodrigues et al. | |
| 2002/0038720 | A1 | 4/2002 | Kai et al. | |
| 2002/0146935 | A1 | 10/2002 | Wong | |
| 2003/0214370 | A1 | 11/2003 | Allison et al. | |
| 2003/0224657 | A1 | 12/2003 | Malloy | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0170692 | A1 | 8/2005 | Montena | |
| 2005/0181652 | A1 | 8/2005 | Montena et al. | |
| 2005/0181668 | A1 | 8/2005 | Montena et al. | |
| 2005/0208827 | A1 | 9/2005 | Burris et al. | |
| 2005/0233636 | A1 | 10/2005 | Rodrigues et al. | |
| 2006/0014425 | A1 | 1/2006 | Montena | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2006/0166552 | A1 | 7/2006 | Bence et al. | |
| 2006/0178046 | A1 | 8/2006 | Tusini | |
| 2007/0026734 | A1 | 2/2007 | Bence et al. | |
| 2007/0123101 | A1 | 5/2007 | Palinkas | |
| 2007/0175027 | A1 | 8/2007 | Khemakhem et al. | |
| 2008/0102696 | A1 | 5/2008 | Montena | |
| 2009/0029590 | A1 | 1/2009 | Sykes et al. | |
| 2009/0098770 | A1 | 4/2009 | Bence et al. | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy et al. | |
| 2011/0021072 | A1 | 1/2011 | Purdy | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2012/0021642 | A1 | 1/2012 | Zraik | |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| CN | 201904508 | U | 7/2011 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| GB | 2477479 | A | 11/2010 |
| JP | 3280369 | B2 | 5/2002 |
| JP | 2006079937 | | 3/2006 |
| KR | 100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |
| WO | 2010135181 | A2 | 11/2010 |
| WO | 2011128665 | A1 | 10/2011 |
| WO | 2011128666 | A1 | 10/2011 |

* cited by examiner

COAXIAL CONNECTOR WITH DUAL-GRIP NUT

CROSS-REFERENCE TO RELATED APPLICATIONS

This application is a continuation of U.S. patent application Ser. No. 12/391,468, filed Feb. 24, 2009, the contents of which is hereby incorporated by reference in its entirety.

BACKGROUND OF THE INVENTION

1. Field of the Invention

The present invention relates generally to coaxial drop cable connectors and related terminals, and particularly to coaxial drop cable connectors having a dual-grip nut.

2. Technical Background

Coaxial cable connectors, such as Type F connectors, are used to attach a coaxial cable to another object, such as an appliance or junction having a terminal, or port, adapted to engage the connector. Coaxial cable and related connectors include inner and outer conductor means separated by a dielectric structure.

Typically, conventional CATV coaxial connectors employ a threaded coupling system comprised of an outer conductor mechanism utilizing an externally hexagonal shaped coupling nut having an internal threaded area and a corresponding threaded port having an external thread. The portion of the interconnecting pair comprising the externally hexagonal shaped coupling nut with an internal threaded area is commonly known as a male connector. The portion of the interconnecting pair comprising the externally threaded area is commonly known as a female connector. The gender of each connector is defined by its corresponding inner conductor configuration and not by the outer conductor configuration.

Installation of the male connector onto the corresponding externally threaded port (female connector) is typically accomplished by rotating the coupling nut of the male connector using finger pressure until the coupling nut cannot be further rotated by hand. Then a wrench is applied to the externally hexagonal shaped coupling nut to secure the connection using the required amount of torque to ensure a dependable junction.

Historically, the hex size of said coupling nut on what is identified as the "male" connector is on the order of 7/16 inches with some versions sized at 1/2 inches or 9/16 inches. The 7/16 inch hex is, by far, the most common size utilized in the CATV connector field and, as a result, most tools i.e., wrenches, carried by installation technicians are of that dimension. These wrenches include both standard wrenches and torque limiting wrenches commonly known as torque wrenches.

The 7/16 inch hex size coupler is particularly well suited for use on connectors accepting series 6 cables and smaller because of their naturally compact size as dictated by the diameter of the corresponding cables. Typically, the bodies of these types of connectors are on the order of 7/16 inches in diameter allowing relatively easy access to the male connector coupling nut with fingers and various wrenches.

A problem, however, can arise when larger connectors, such as those capable of accepting series 11 cable, are utilized in the field. Said connectors typically utilize connector bodies on the order of 9/16 inches in diameter. This increased body size over that of series 6 connectors can obscure or at least partially obscure a coupling nut with a 7/16 inch hex configuration, making it difficult to reach said coupling nut for purposes of installation and removal from a female port.

One method used to address this issue is to employ a coupling nut with a 1/2 or 9/16 inch hex configuration. However, this provides a difficulty for the field technician equipped with only a 7/16 inch wrench. In particular, this provides a difficulty for the technician who is required to use a comparatively expensive torque wrench on all connectors installed outside of a structure when his only torque wrench has an aperture of 7/16 inches.

In situations where it is desirable to deter theft of CATV services, the use of a protective system comprising an outer shell commonly known as a security shield and a special hollow wrench commonly known as a security tool is typically applied. The use of said shell, however, renders it practically impossible to access a 7/16 inch or 1/2 inch hex coupling nut to secure the interconnect system. In these cases, a hexagonal coupling nut on the order of 9/16 inches must be utilized.

Another problem often encountered with relatively larger connectors relates to withstanding forces applied essentially perpendicular to the axis of the connector. Forces induced by wind, snow load, or physically pulling on the cable are capable of mechanically breaking the outer conductor mechanism of many of the products currently on the market.

An additional issue encountered by the use of 7/16 inch coupling nuts on relatively large-bodied connectors is the resistance of said coupling nut to rotation when in contact with a sealing member, such as an o-ring or the like. The relatively small coupling nut is difficult to grasp by reaching around the large connector body and the impingement of the o-ring necessary to prevent moisture ingress renders the coupling difficult to rotate. Additionally, this impingement of said o-ring causes difficulty in rotation for couplers of various hex sizes, such as 9/16 inch hex and various other configurations.

In situations where larger hexagonal coupling nuts (coupling nuts on the order of 9/16 inches) are utilized, it is often advantageous to rotatably attach said coupling nut to the related connector body by means of a retaining ring or snap ring. This type of arrangement, however, can be difficult to implement due to requirement of use of special factory assembly tooling and methods to ensure that said snap ring remains centered during assembly and is properly positioned after assembly.

SUMMARY OF THE INVENTION

One aspect of the invention is a connector for coupling the end of a coaxial cable to a port, the coaxial cable having a center conductor surrounded by a dielectric, the dielectric surrounded by an outer conductor, and the outer conductor being surrounded by a jacket. The connector includes a generally cylindrical body member having a first end and a second end, the first end of the cylindrical body member having a central bore for accepting the end of the coaxial cable. In addition, the connector includes a coupling nut having a first end for rotatably engaging the second end of the cylindrical body member, the coupling nut having an opposing second end with an internally threaded bore for engaging the port. The coupling nut further includes a first external gripping surface having a plurality of flat sides and a second external gripping surface having a plurality of flat sides, wherein the smallest outer diameter of the first external gripping surface is less than the smallest outer diameter of the second external gripping surface.

In another aspect, the present invention includes a method of assembling a connector for coupling the end of a coaxial cable to a port, the coaxial cable having a center conductor surrounded by a dielectric, the dielectric surrounded by an outer conductor, and the outer conductor being surrounded by a jacket. The method includes axially advancing a coupling nut along a second end of a generally cylindrical body member in the direction of a first end of the generally cylindrical body member, the first end of the generally cylindrical body member having a central bore for accepting the end of the coaxial cable. The coupling nut includes a first end for rotatably engaging the second end of the cylindrical body member, the coupling nut having an opposing second end with an internally threaded bore for engaging the port. The coupling nut further includes a first external gripping surface having a plurality of flat sides and a second external gripping surface having a plurality of flat sides, wherein the smallest outer diameter of the first external gripping surface is less than the smallest outer diameter of the second external gripping surface.

Potential advantages of one or more embodiments disclosed herein can include the ability to use tools of various sizes for tightening, due to the presence of first and second external gripping surfaces having differing smallest outer diameters. In addition, second external gripping surface allows for installation and removal with a security tool and security sleeve. Also, multiple points of support between coupling nut and connector body provide improved resistance to side load forces and the design incorporating a retaining ring provides an improved method for installing coupling nut onto connector body. Embodiments disclosed herein can also include use of a seal ring, pop up pin with rotating insulting member, and configuration with free spinning coupling nut with o-ring, which facilitates finger tightening of connector to a mating port while providing environmental sealing.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
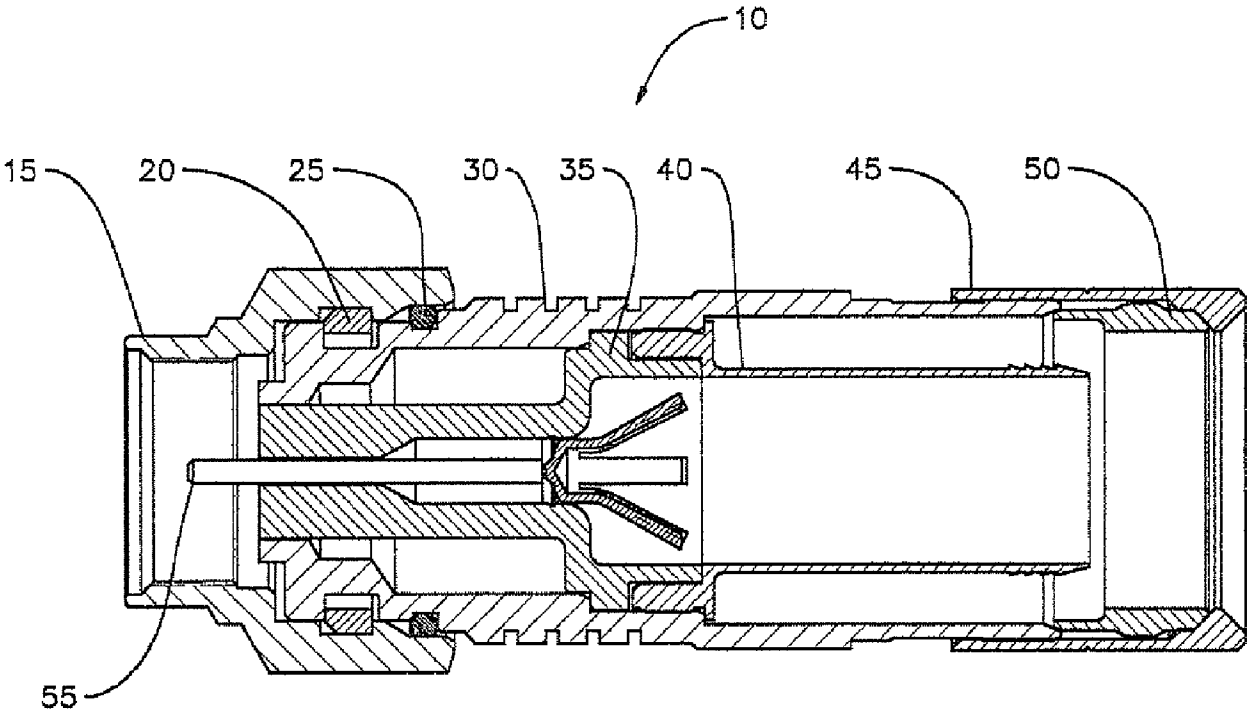
FIGURE 1 PRIOR ART
FIG. 1 illustrates a partial cross sectional view of a prior art connector having a coupling nut with a single external hexagonal portion.

FIG. 1 illustrates a partial cutaway view along the centerline of a prior art compression series 11F connector 10, having a coupling nut with a single external hexagonal portion. The connector illustrated in FIG. 1 includes coupling nut 15, retaining ring 20, o-ring 25, body 30, insulator 35, post 40, compression ring 45, gripping member 50, and pin 55.

Figure 1A:
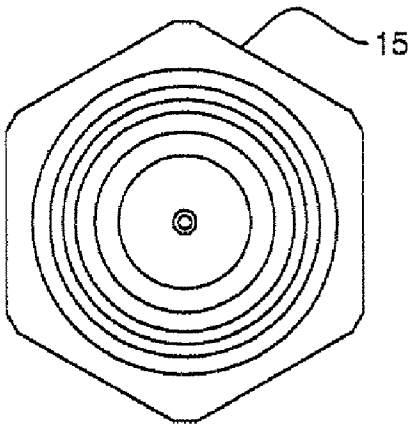
FIG. 1A illustrates a schematic end view of the connector illustrated in FIG. 1.

FIG. 1A illustrates a schematic end view of the connector illustrated in FIG. 1, showing the single hexagonal nature of the exterior of coupling nut 15.

Figure 2:
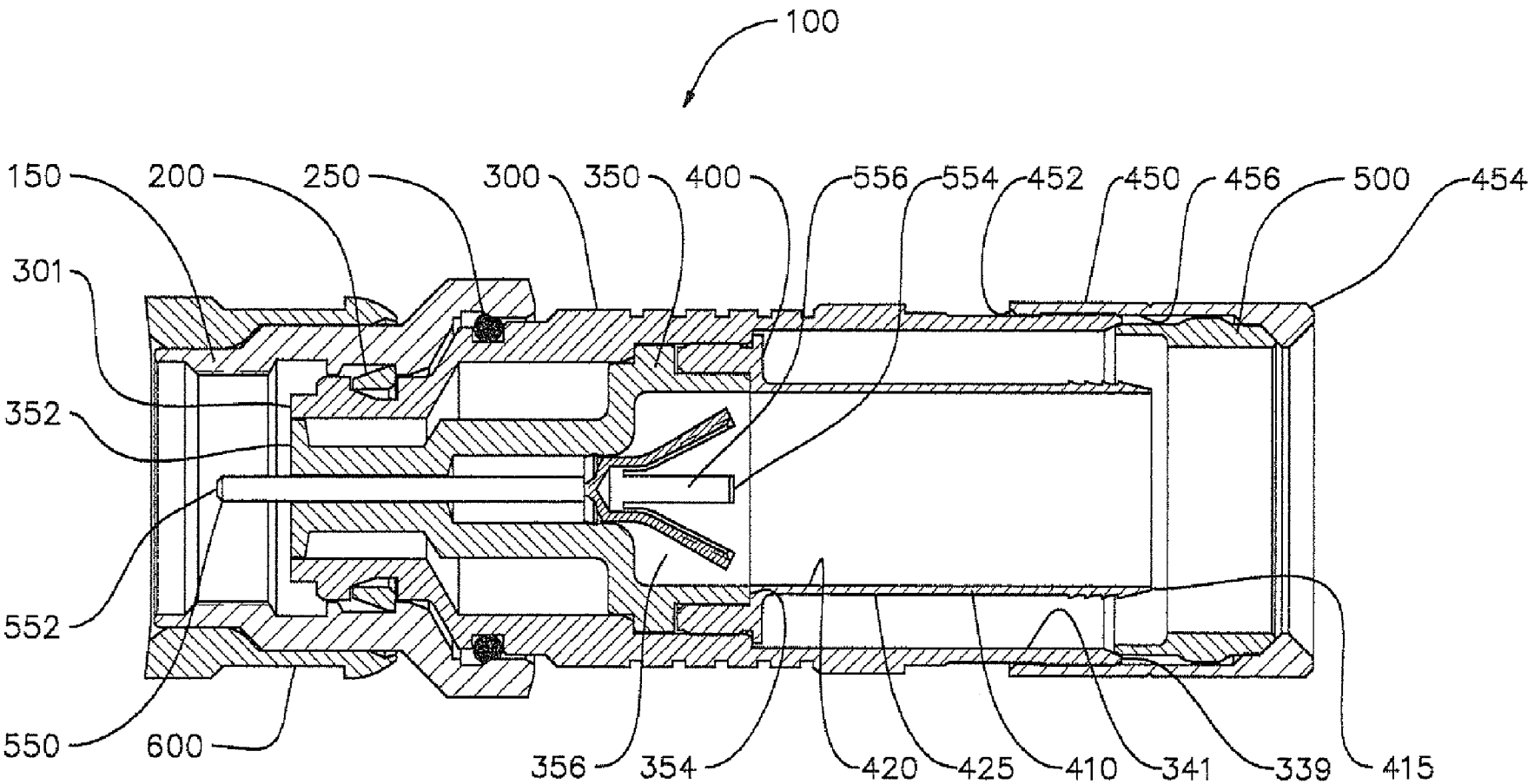
FIG. 2 illustrates a partial cross sectional view of an embodiment of the present invention.

FIG. 2 is a partial cutaway view along the centerline of an embodiment of the present invention. The connector 100 illustrated in FIG. 2 includes coupling nut 150, retaining ring 200, o-ring 250, generally cylindrical body member 300, insulating member 350, tubular post 400, compression ring 450, deformable gripping member 500, pin 550, and optional seal ring 600. Coupling nut 150 is preferably made from a metallic material, such as brass, and is preferably plated with a conductive, corrosion resistant material, such as nickel. Retaining ring 200 is preferably made from a metallic material for electrical continuity, such as heat treated beryllium copper, which is an electrical conductor. O-Ring 250 is preferably made from a rubber-like material, such as EPDM (Ethylene Propylene Diene Monomer). Generally cylindrical body member 300 has first end 339, second end 301, and a central bore 341 and is preferably made from a metallic material, such as brass, and is preferably plated with a conductive, corrosion resistant material, such as nickel. Insulating member 350 includes a front end 352, a rear end 354, and an opening 356 between the front and rear ends and is preferably made of an insulative plastic material, such as high-density polyethylene or acetal. At least a portion of rear end 354 of insulating member 350 is in contact with at least a portion of tubular post 400. Tubular post 400 includes a tubular shank 410 having a rear end 415, an inner surface 420, and an outer surface 425 and is preferably made from a metallic material, such as brass, and is preferably plated with a conductive, corrosion resistant material, such as tin. Outer surface 425 of tubular shank 410 and central bore 341 of generally cylindrical body member 300 define an annular cavity therebetween. Compression ring 450 surrounds first end 339 of cylindrical body member 300 and includes a front end 452, a rear end 454, and an inner surface 456 defining a longitudinal opening between front end 452 and rear end 454 and is axially movable over cylindrical body member 300 between a rearward position and a forward position. Compression ring 450 is preferably made from a metallic material, such as brass, and is preferably plated with a conductive, corrosion resistant material, such as nickel. Deformable gripping member 500 is disposed within the longitudinal opening of compression ring 450 and is preferably made of an insulative plastic material, such as high-density polyethylene or acetal. Pin 550 has a front end 552, a rear end 554, and a flared portion 556 at its rear end 554 to assist in guiding an inner conductor of a coaxial cable into physical and electrical contact with pin 550. Pin 550 is inserted into and substantially along opening 356 of insulating member 350 and is preferably made from a metallic material, such as brass, and is preferably plated with a conductive, corrosion resistant material, such as tin. Pin 550 and insulating member 350 are rotatable together relative to generally cylindrical body member 300 and tubular post 400. Seal ring 600 is preferably made from a rubber-like material, such as silicone.

Figures 3, 3A, 3B:
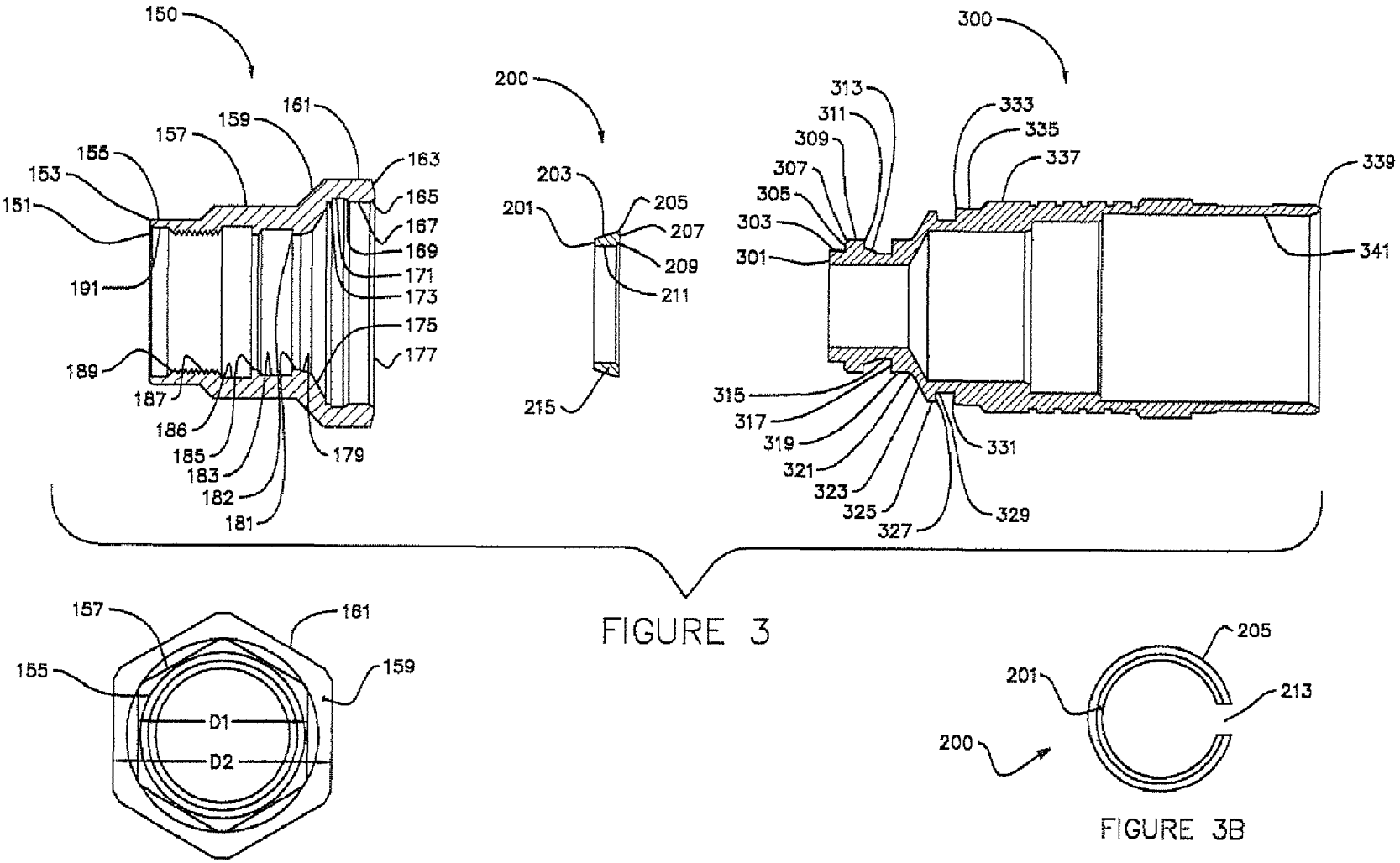
FIG. 3 illustrates an exploded view of select components of the embodiment illustrated in FIG. 2, including a coupling nut, body, and retaining ring.
FIG. 3A illustrates a schematic end view of the coupling nut illustrated in FIG. 3.
FIG. 3B illustrates a schematic end view of the retaining ring illustrated in FIG. 3.

Referring to FIG. 3, coupling nut 150 includes second end 151, radiused or chamfered portion 153, sealing diameter 155, first external gripping surface 157, transitional area 159, second external gripping surface 161, rear transitional area 163, rear chamfer 165, sealing bore 167, internal taper 169, undercut 171, counterbore 173, internal transition 175, first end 177, internal taper 179, through bore 181, forward facing annular shoulder 182, undercut 183, through bore 185, undercut 186, internally threaded bore 187, internal transition area 189, and counter bore 191. As is clearly illustrated in FIG. 3, the through bore 185 and the undercut 186 collectively form an inward lip on the coupling nut 150. Similarly, the through bore 181 and the undercut 183 collectively form an additional inward lip in the form of the aforementioned annular shoulder 182. The retaining ring 200 of FIG. 3 is installed rearward of the inward lip formed by the through bore 185 and the undercut 186, in the manner illustrated in FIGS. 4A-4F, which are described in further detail below. First external gripping surface 157 and second external gripping surface 161 each have a plurality of flat sides and the smallest outer diameter of the second external gripping surface 161 is greater than the smallest outer diameter of the first external gripping surface 157. Preferably, first external gripping surface 157 and second external gripping surface 161 are each hexagonal or hex-shaped (as shown in FIG. 3A), such that the smallest outer diameter of either surface is the distance between opposite flat sides (shown as D1 and D2 in FIG. 3A). As shown in FIG. 3, second external gripping surface 161 is axially between the first end of the coupling nut and the first external gripping surface 157 and second external gripping surface 161 is axially spaced apart from first external gripping surface 157 by transitional area 159. Preferably, second external gripping surface 161 has a smallest outer diameter of greater than ½ inch and first external gripping surface 157 has a smallest outer diameter of less than ½ inch.

Continuing in FIG. 3, retaining ring 200 includes front end 201, external taper 203, outside diameter 205, back end 207, chamfer 209, internal diameter 211, and cross sectional beam 215. Retaining ring 200 is preferably c-shaped (as shown in FIG. 3B) and external taper 203 causes retaining ring to increase in outside diameter between front end 201 and back end 207.

Generally cylindrical body member 300 includes first end 339, central bore 341, second end 301, diameter 303, forward facing annular shoulder 305, chamfer 307, diameter 309, rearward facing annular shoulder 311, tapered portion 313, groove 315, forward facing annular shoulder 317, diameter 319, radius 321, transition area 323, diameter 325, rearward facing annular shoulder 327, groove 329, forward facing annular shoulder 331, chamfer 333, outer diameter 335, and outer diameter 337.

FIG. 3A is a schematic end view of coupling nut 150 comprising sealing diameter 155, first external gripping surface 157, transitional area 159, and second external gripping surface 161, wherein first external gripping surface 157 and second external gripping surface 161 are both hexagonal or hex-shaped. The smallest outer diameter D1 of the first external gripping surface 157 is less than the smallest outer diameter D2 of the second external gripping surface 161. Preferably, first external gripping surface 157 has a smallest outer diameter of less than ½ inch and second external gripping surface 161 has a smallest outer diameter of greater than ½ inch. In a particularly preferred embodiment, first external gripping surface 157 has a smallest outer diameter of about 7/16 of an inch and second external gripping surface 161 has a smallest outer diameter of about 9/16 of an inch.

FIG. 3B is a schematic end view of retaining ring 200 comprising front end 201, outside diameter 205, and slot 213. As shown in FIG. 3B, retaining ring 200 is c-shaped and when the retaining ring 200 is installed in the snap-fit manner described with reference to FIGS. 4A-4B below, the electrically conductive retaining ring comprises an engagement gap that may be spring-loaded. The conductive retaining ring does not engage a portion of the inner surface of the coupling nut at the engagement gap, the engagement gap being defined between adjacent portions of the electrically conductive retaining ring that are in electrically conductive engagement with the coupling nut.

Figure 4A:
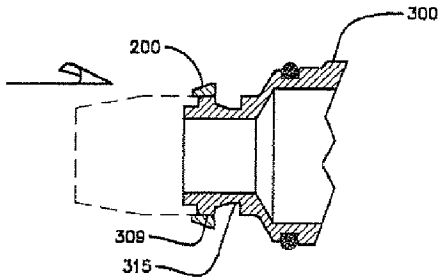
FIGS. 4A-4E illustrate partial cross sectional views of the connector illustrated in FIG. 2, showing various stages of component assembly.

Turning to FIG. 4A retaining ring 200 is illustrated in a state of partial assembly onto generally cylindrical body member 300. Retaining ring 200 is axially advanced along the second end 301 of generally cylindrical body member 300 in the direction of the first end 339 of generally cylindrical body member 300 over a tapered expanding tool illustrated in phantom. Slot 213 in retaining ring 200 permits retaining ring 200 to expand and pass over body diameter 309.

Figure 4D:
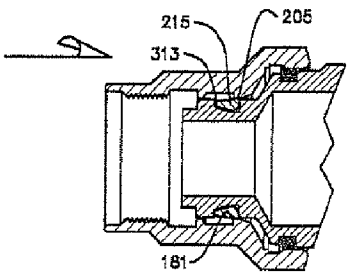
Figure 4B:
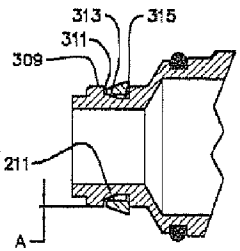

In FIG. 4B, retaining ring 200 is axially advanced into groove 315 extending radially inwardly in an outer surface of the generally cylindrical body member 300. Retaining ring 200, due to its resilient nature, snaps into groove 315 and is forced to remain relatively radially evenly disposed about groove 315 by contact between tapered portion 313 of generally cylindrical body member 300 and proximal end of internal diameter 211 of retaining ring 200. This centering action causes proximal end of external taper 203 to remain co-cylindrically aligned with or below diameter as illustrated by dimension "A" ensuring unimpeded engagement with internal taper 179 of coupling nut 150 when coupling nut 150 is axially advanced towards first end 339 of generally cylindrical body member 300. Coincidentally, as coupling nut 150 is axially advanced towards first end 339 of generally cylindrical body member 300, chamfer 165 of coupling nut 150 begins to funnel o-ring 250 into sealing bore 167 of coupling nut 150.

Figure 4E:
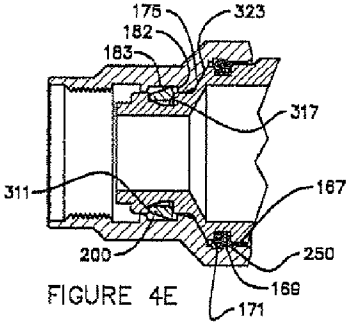
Figure 4C:
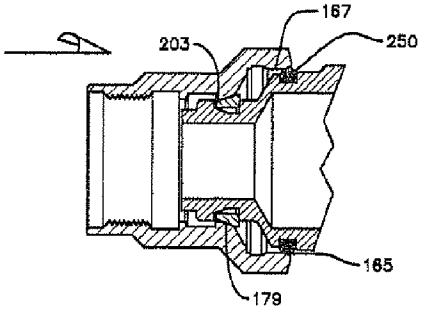

In FIG. 4C, coupling nut 150 is axially advanced along second end 301 of generally cylindrical body member 300 in the direction of first end 339 of generally cylindrical body member 300. As a result of the axial advancement of coupling nut 150, retaining ring 200, which is disposed about generally cylindrical body member 300 proximate to its second end 301, is also disposed within an inner surface of coupling nut 150.

In FIG. 4D, upon further advancement of coupling nut 150 over generally cylindrical body member 300 and over retaining ring 200, contact between through bore 181 and outside diameter 205 causes retaining ring 200 to compress radially inwardly. Specifically, through bore 181 forces cross sectional beam 215 of retaining ring 200 to both radially compress in diameter and torsionally conform to groove 315 and tapered portion 313 of generally cylindrical body member 300 allowing coupling nut to continue to advance without the need for alignment and/or pre-compression tooling to be applied to retaining ring 200 in what is known as a blind assembly operation.

In FIG. 4E coupling nut 150 is completely advanced until internal transition 175 is arrested against body transition area 323 and through bore 181 is axially advanced past retaining ring 200 at which point retaining ring 200 is permitted to re-expand radially outwardly to its original configuration, now diametrically bounded within undercut 183 and axially bounded by forward facing annular shoulder 182, forward facing annular shoulder 317, and rearward facing annular shoulder 311. Coupling nut 150, proximate to its first end 177, rotatably engages generally cylindrical body member 300 proximate to its second end 301. Coupling nut 150 is rotationally captivated while being permitted some axial movement limited by the bounds described. O-ring 250 is disposed about generally cylindrical body member 300 proximate to its second end 301 and disposed within inner surface of coupling nut proximate to its first end 177. O-ring 250 passes through or at least partially passes through sealing bore 167 and is permitted to expand or at least partially expand into undercut 169 providing limited contact or even clearance between o-ring 250 and the internal configuration of coupling nut 150. Before internally threaded bore 187 engages port 750, said limited contact or permitted clearance between o-ring 250 and coupling nut 150 and said limited axial movement allows coupling nut to be freely rotated relative to the generally cylindrical body member 300, achieving what is known in the industry as a "free spinning" condition.

Figure 4F:
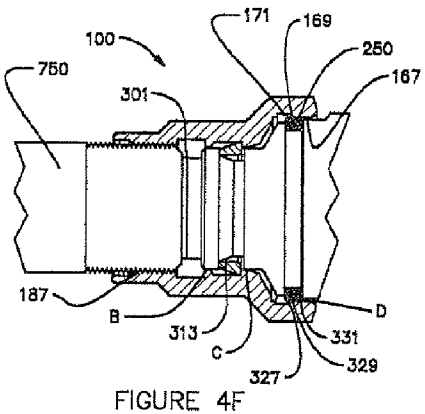
FIG. 4F illustrates a partial cross sectional view of the connector illustrated in FIG. 2, showing the connector mated to a corresponding port.

Turning to FIG. 4F, a partial cross sectional view of connector 100 is illustrated connected to mating port, or port 750. Connector front end 301 is drawn into positive electrical and mechanical communication with port 750 by means of threading coupling nut 150 onto port 750. As internally threaded bore 187 of coupling nut 150 is advanced onto port 750, back end 207 of retaining ring 200 is driven by forward facing annular shoulder or internal lip 182 of coupling nut 150, causing front end 201 of retaining ring 200 to engage rearward facing annular shoulder 311 of generally cylindrical body member 300 thus driving front end 301 of generally cylindrical body member 300 firmly against port 750. As coupling nut 150 advances axially in relation to generally cylindrical body member 300, o-ring 250 is forced under sealing bore 167 of coupling nut 150, creating an environmentally sealed junction. The proximity of through bore 181, through bore 185, and sealing bore 167 to corresponding body diameters as illustrated by "B", "C" and "D" respectively, provides a multiplicity of effective support areas for generally cylindrical body member 300 against side loading forces that may be applied to the connector junction. This multiplicity of support areas working in conjunction with tapered area 313 of generally cylindrical body member 300, provides additional gusseting reinforcement within generally cylindrical body member 300, and, in conjunction with retaining ring 200, creates a physically robust and dependable junction. Upon removal of connector 100 from port 750, coupling nut 150 is permitted to return axially rearward, allowing o-ring 250 and coupling nut 150 to return to the free-spinning state.

Figure 5:
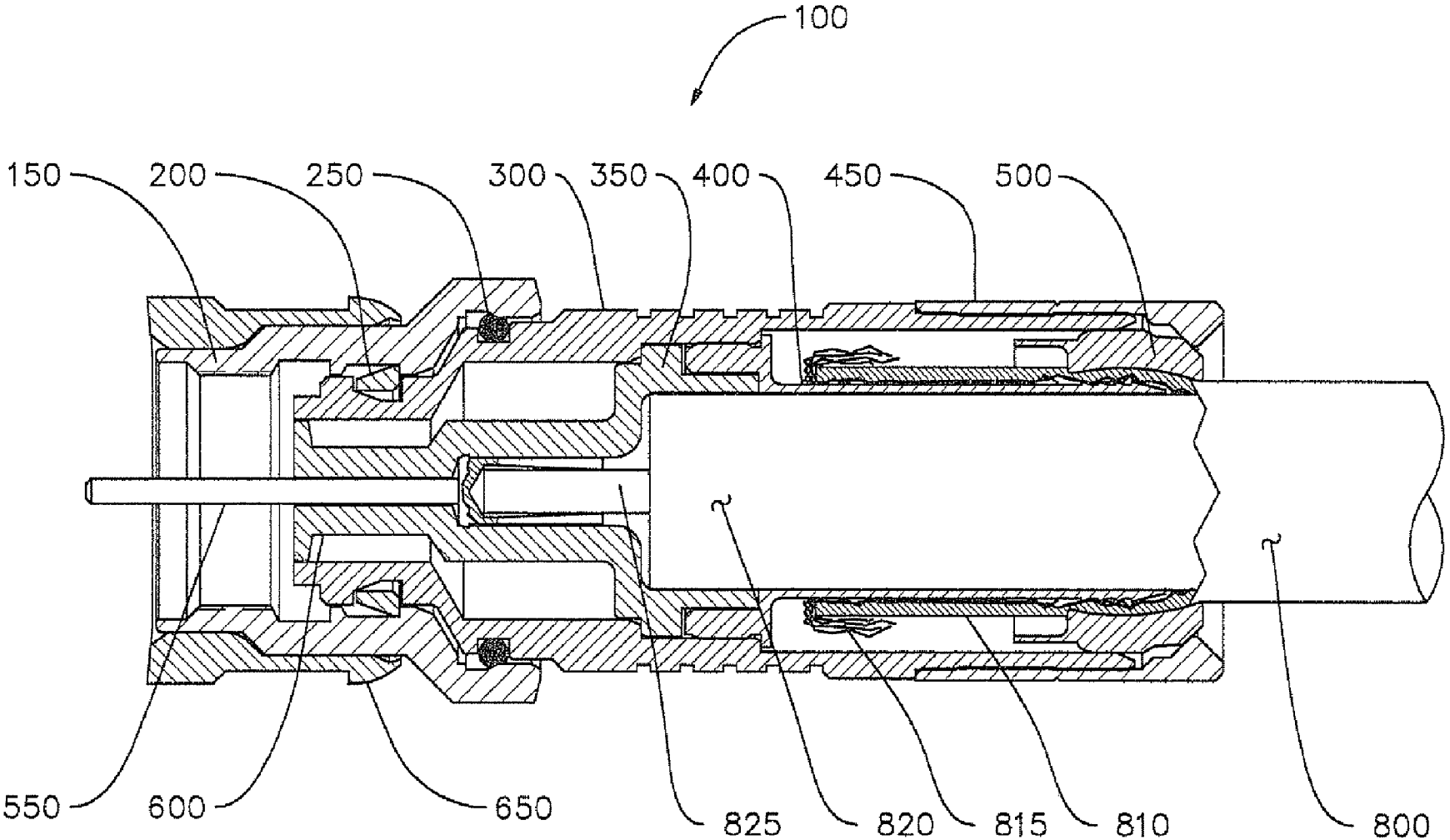
FIG. 5 illustrates a partial cross sectional view of the connector illustrated in FIG. 2, wherein the connector is installed on a coaxial cable.

FIG. 5 is a partial cutaway view along the centerline of a connector from FIG. 2 illustrating the connector installed on a coaxial cable 800. Coaxial cable 800 includes a center conductor 825 surrounded by a dielectric 820, the dielectric surrounded by an outer conductor 815, and the outer conductor being surrounded by a jacket 810. Coaxial cable 800 is accepted into central bore 341 through first end 339 of generally cylindrical body member 300. Compression ring 450 is axially advanced about generally cylindrical body member 300 such that in a forward position, at least a portion of the deformable gripping member 500 is compressed radially inward by the cylindrical body member 300 and the compression ring 450 such that deformable gripping member 500 is in a compressed condition about coaxial cable 800.

Figure 6:
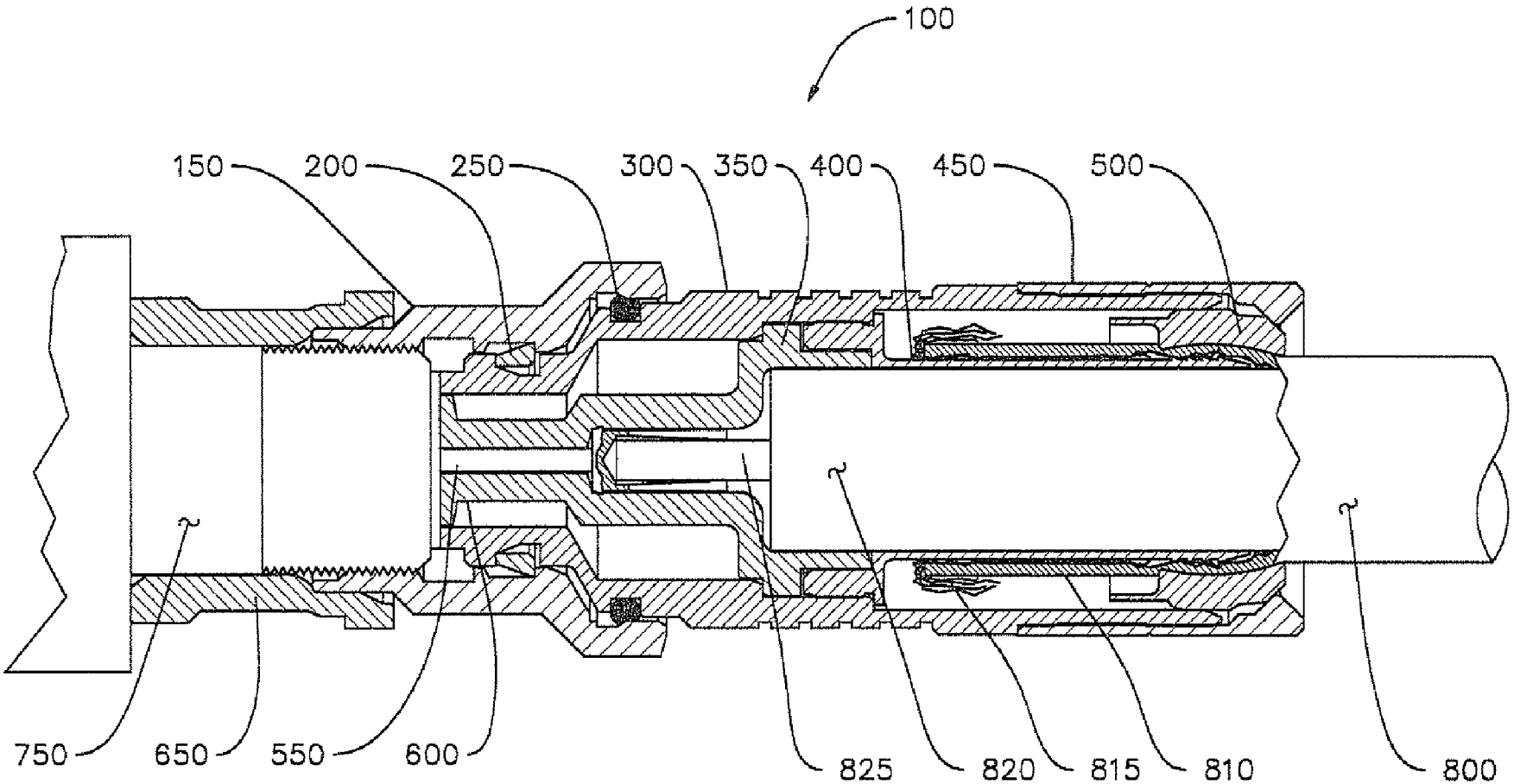
FIG. 6 illustrates a partial cross sectional view of the connector illustrated in FIG. 2, wherein the connector is installed on a coaxial cable and mated to a corresponding port with a seal ring illustrated in the deployed condition.

FIG. 6 is a partial cutaway view along the centerline of connector 100 from FIG. 2 illustrating said connector installed on a coaxial cable 800 and installed on a corresponding port 750 with seal ring 650 illustrated in the deployed condition.

Figure 7:
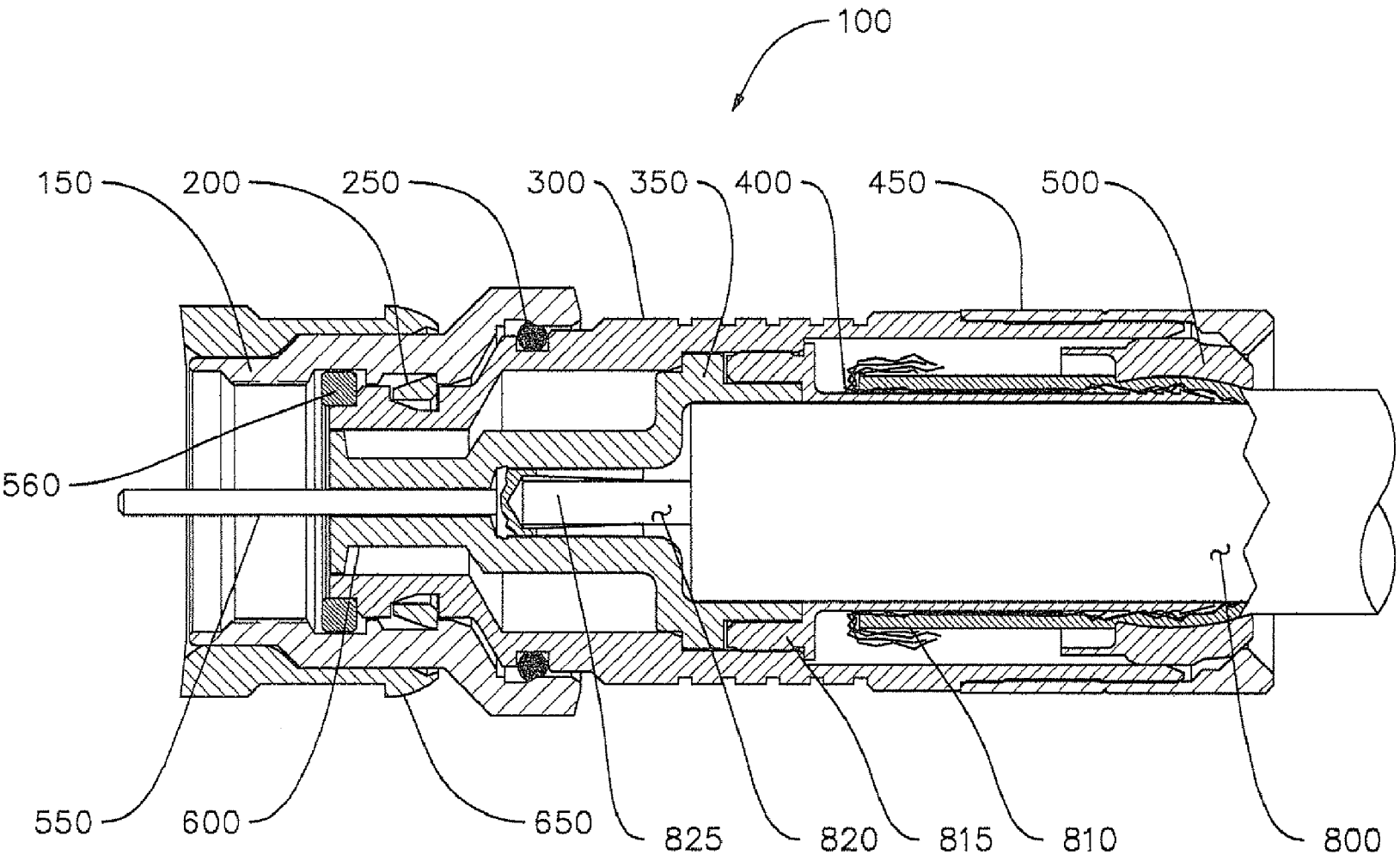
FIG. 7 illustrates a partial cross sectional view of the connector illustrated in FIG. 2, wherein the connector is installed on a coaxial cable and wherein the connector has an optional interface seal ring.

FIG. 7 is a partial cutaway view along the centerline of connector 100 from FIG. 2 illustrating said connector installed on a coaxial cable 800 with optional interface seal ring 560.

Figure 8:
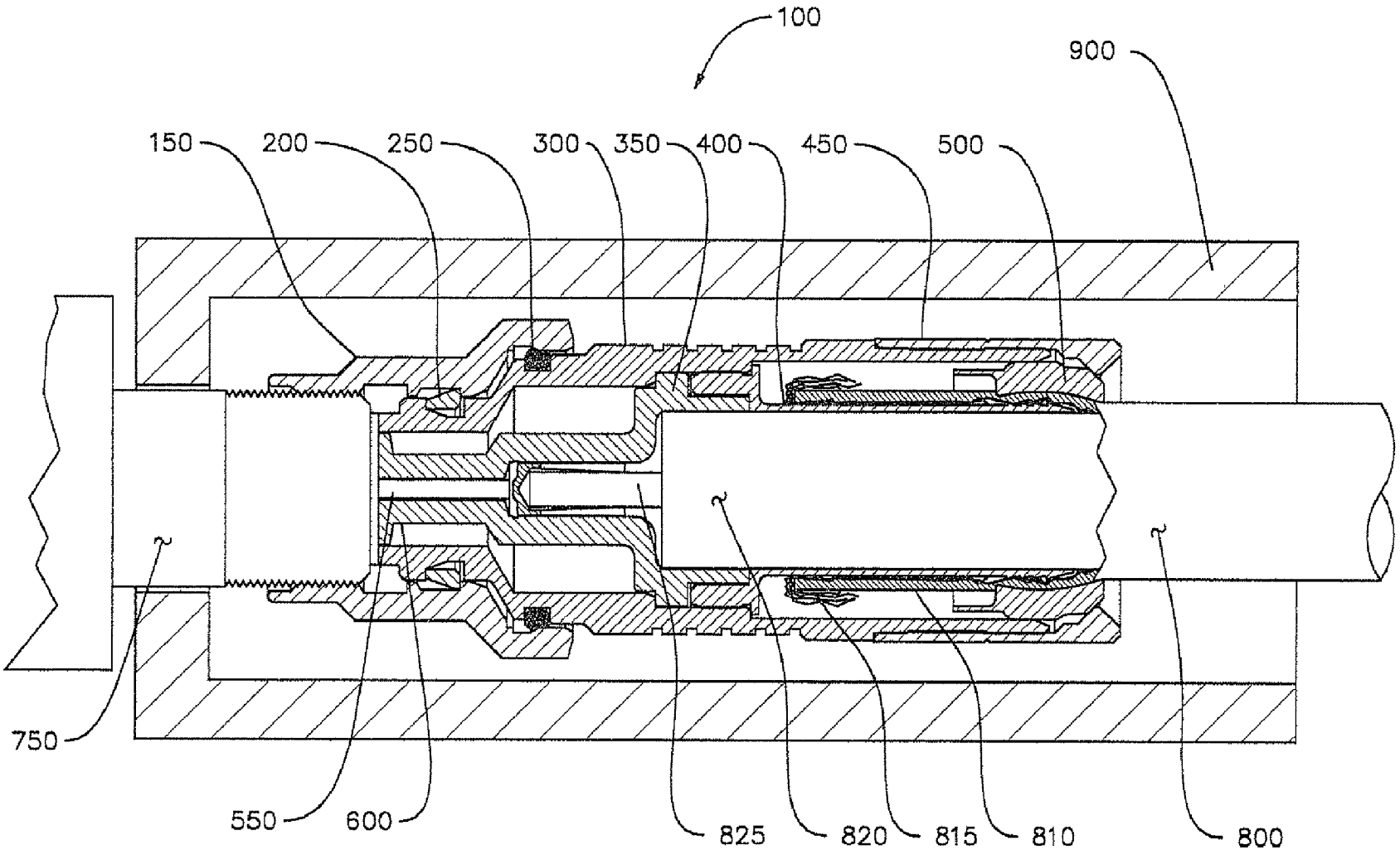
FIG. 8 illustrates a partial cross sectional view of the connector illustrated in FIG. 2, wherein the connector is installed on a coaxial cable, mated to a corresponding port, and enshrouded by a security sleeve.

FIG. 8 is a partial cutaway view along the centerline of connector 100 from FIG. 2 illustrating said connector without seal ring 650. Connector 100 is illustrated as installed on a coaxial cable 800 and installed on corresponding port 750. Additionally, connector 100 and port 750 are enshrouded, or at least partially enshrouded or surrounded, by security sleeve 900. FIG. 8 highlights a purpose for second external gripping surface 161 of coupling nut 150 in that when connector 100 is used in conjunction with security sleeve 900, it is physically impossible to access first external gripping surface 157 of coupling nut 150. In cases wherein the connector system is utilized without security sleeve 900, second external gripping surface 161 of coupling nut 150 provides and improved means for gripping and applying increased finger induced torque to coupling nut 150. Second external gripping surface 161 provides a means for use of optional tools such as open-end wrenches and security tools other than those of 7/16 inches opening. First external gripping surface 157 provides a means for use of open-end wrenches and industry standard torque wrenches when connector 100 is used without security sleeve 900.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A connector for coupling the end of a coaxial cable to a port, the coaxial cable having a center conductor surrounded by a dielectric, the dielectric surrounded by an outer conductor, and the outer conductor surrounded by a jacket, said connector comprising:

a generally cylindrical body member having a first end, a second end, a rearward facing annular shoulder, a groove, and a tapered portion positioned axially between the rearward facing annular shoulder and the groove, wherein the first end of said cylindrical body member comprises a central bore for accepting the end of the coaxial cable;

a coupling nut comprising a first end for rotatably engaging the second end of the cylindrical body member, an opposing second end with an internally threaded bore for engaging the port, and an annular shoulder in the form of an inward lip; and an electrically conductive retaining ring having a front end, a back end, and an internal diameter, wherein said conductive retaining ring is disposed about said generally cylindrical body member proximate to the second end thereof such that the internal diameter of the electrically conductive retaining ring contacts the tapered portion of the generally cylindrical body member, and the electrically conductive retaining ring is disposed within an inner surface of the coupling nut bounded in part by said annular shoulder for free spinning engagement of the coupling nut and the cylindrical body member.

2. The connector of claim 1, wherein the electrically conductive retaining ring further comprises an external taper extending from the front end to the back end.

3. The connector of claim 2, wherein when the coupling nut is assembled onto the generally cylindrical body member, a through bore of the coupling nut contacts the external taper of the electrically conductive retaining ring to compress the electrically conductive retaining ring radially inward.

4. The connector of claim 1, wherein said conductive retaining ring is installed rearward of the inward lip formed by the annular shoulder.

5. The connector of claim 1, wherein the tapered portion of the generally cylindrical body member increases in diameter in a forward direction from the groove to the rearward facing annular shoulder.

6. The connector of claim 1, wherein the rearward facing annular shoulder limits forward translation of the electrically conductive retaining ring.

7. The connector of claim 1, wherein the generally cylindrical body member contacts the electrically conductive retaining ring on an internal diameter of the electrically conductive retaining ring and the coupling nut contacts the electrically conductive retaining ring on the outside diameter of the electrically conductive retaining ring.

8. The connector of claim 1, wherein the electrically conductive retaining ring contacts the coupling nut at a portion that is other than by an entire circumference of the electrically conductive retaining ring to maintain electrical continuity between the electrically conductive retaining ring and the coupling nut.

9. The connector of claim 1, wherein contact between the electrically conductive retaining ring and the tapered portion of the generally cylindrical body member maintain electrical continuity between the electrically conductive retaining ring and the generally cylindrical body.

10. A connector for coupling the end of a coaxial cable to a port, the coaxial cable having a center conductor surrounded by a dielectric, the dielectric surrounded by an outer conductor, and the outer conductor surrounded by a jacket, said connector comprising:

a generally cylindrical body member having a first end and a second end, the first end of said cylindrical body member comprising a central bore for accepting the end of the coaxial cable;

a coupling nut comprising a first end for rotatably engaging the second end of the cylindrical body member, an opposing second end with an internally threaded bore for engaging the port, and an annular shoulder in the form of an inward lip; and an electrically conductive retaining ring disposed proximate to the second end of said generally cylindrical body member, wherein the electrically conductive retaining ring contacts the coupling nut at a portion that is other than an entire circumference of the electrically conductive retaining ring to maintain electrical continuity between the electrically conductive retaining ring and the coupling nut.

11. The connector of claim 10, wherein the coupling nut is bounded in part by said annular shoulder for engagement of an inner surface of the coupling nut.

12. The connector of claim 10, wherein the coupling nut is in a spinning engagement with the generally cylindrical body.

13. The connector of claim 10, wherein the electrically conductive retaining ring is in axial contact with the coupling nut.

14. The connector of claim 10, wherein said conductive retaining ring is installed rearward of the inward lip formed by the annular shoulder.

15. The connector of claim 10 further comprising an o-ring that forms a seal between the generally cylindrical body member and coupling nut at a position proximate to the first end of the coupling nut.

16. The connector of claim 10, wherein contact between the electrically conductive retaining ring and the generally cylindrical body member maintains co-cylindrical alignment between the electrically conductive retaining ring and the generally cylindrical body member.

17. A connector for coupling the end of a coaxial cable to a port, the coaxial cable having a center conductor surrounded by a dielectric, the dielectric surrounded by an outer conductor, and the outer conductor surrounded by a jacket, said connector comprising:

a generally cylindrical body member having a first end and a second end, the first end of said cylindrical body member comprising a central bore for accepting the end of the coaxial cable;

a coupling nut comprising a first end for rotatably engaging the second end of the cylindrical body member, an opposing second end with an internally threaded bore for engaging the port, and an annular shoulder in the form of an inward lip; and an electrically conductive retaining ring disposed within an inner surface of the coupling nut for engagement of the coupling nut, wherein the electrically conductive retaining ring comprises an engagement gap at which the conductive retaining ring does not engage a portion of the inner surface of the coupling nut, the engagement gap being defined between portions of the electrically conductive retaining ring that are in electrically conductive engagement with the coupling nut.

18. The connector of claim 17, wherein the engagement gap is spring-loaded.

19. The connector of claim 17, wherein the coupling nut is in a spinning engagement with the generally cylindrical body.

20. The connector of claim 17, wherein the electrically conductive retaining ring is in axial contact with the coupling nut.

21. The connector of claim 17, wherein the coupling nut is bounded in part by said annular shoulder for engagement of said inner surface of the coupling nut.

* * * * *